United States Patent [19]

Remington

[11] Patent Number: 4,488,562

[45] Date of Patent: Dec. 18, 1984

[54] CIGARETTE MAKING WITH TEMPERATURE CONDITIONING

[75] Inventor: James A. Remington, Richmond, Va.

[73] Assignee: Philip Morris, Incorporated, New York, N.Y.

[21] Appl. No.: 404,784

[22] Filed: Aug. 3, 1982

[51] Int. Cl.[3] ..... A24C 5/02; A24C 5/18

[52] U.S. Cl. ..... 131/79; 131/31; 131/62; 131/84 R

[58] Field of Search ..... 131/79, 31, 62, 84 R

[56] References Cited

U.S. PATENT DOCUMENTS 3,672,373 6/1972 Dogl et al. ..... 131/84 R

FOREIGN PATENT DOCUMENTS 953792 4/1964 United Kingdom ..... 131/62

*Primary Examiner*—V. Millin

[57] ABSTRACT

A method and apparatus for producing a tobacco rod of predictable characteristics whereby the tobacco filler is tempered prior to forming into a rod in a cigarette making apparatus. The tobacco filler is tempered prior to entry into the maker region to a temperature of from 32° F. to just below ambient. Heat exchange coils are provided in a feed chamber wherein the tobacco filler is recirculated for tempering to desired temperature prior to being fed to the maker on a continuous basis.

9 Claims, 2 Drawing Figures

CIGARETTE MAKING WITH TEMPERATURE CONDITIONING

BACKGROUND OF THE INVENTION

This invention pertains to cigarette production, and more particularly, to temperature conditioning of tobacco to below ambient temperature prior to forming it into a cigarette rod in a cigarette maker.

Cigarette makers are well known in the prior art and a typical unit of this type is sold by Molins Machine Company Ltd. under model number MK9. In the operation of such makers, it is customary for the tobacco filler to be introduced into a feed hopper from which it is fed to a maker region where it is subjected to a pressure differential. In this region, the filler is carried by means of an air flow caused by the pressure differential to a thin, air permeable conveyor or belt. The tobacco is accumulated on the belt and initiates early formation of an accumulation of tobacco which later becomes the maker output cigarette rod. Formation of cigarettes from the rod is carried out by the other customary components of the maker. It is also customary in the trade, to control the temperature and moisture content of the environment in which the aforesaid makers are housed. This is done in order to provide a certain measure of control over the resultant temperature and moisture of the tobacco filler as fed for forming the tobacco rod, and therefore, the resultant desired temperature of the rod produced at the maker. As an example of an attempt to better control rod characteristics, it has been proposed in copending application Ser. No. 111,521, filed Jan. 14, 1980 and assigned to the same assignee hereof, to control the output rod moisture content, for instance, by measuring the moisture content in the maker and adding or subtracting moisture to or from the input stream of tobacco to control moisture content in the rod delivered by the maker.

In such a procedure, a change made in moisture content will affect, to a degree, the firmness of the rod for a given temperature. Therefore, in addition to control over output rod tobacco moisture contents the temperature must be controlled. It would be beneficial and desirable to have a more positive and much higher degree of temperature control of the tobacco filler during transit through the maker to better condition the rod for handling under extremely high speeds in the maker. Such precise control of temperature would enable one to better interpret the readings of the sensing mechanisms of the maker, such as the readings of the firmness levels and the mass of the tobacco as well as the moisture content. Also, for instance, the cutting action of the cigarette rod cutting apparatus may produce fewer rejects due to tobacco dislodged during cutting if rod temperature is reduced by cooling to below ambient temperature.

A further advantage which results from the control of filler temperature by cooling prior to making up the cigarette rod to below ambient temperature is better control of the cigarette characteristics which result after the manufactured cigarettes are placed into a cigarette pack and are passed on into the channels of commerce. The inventor recognized the significance of the full effect of the below-ambient level of temperature at which the filler is held while transiting through the maker in that not only does filler temperature affect the efficacy of the making machine functions, it also affects the final characteristics of the cigarette as a product when it finally equilibrates in residence in the pack. The feel of a cigarette to the hand of a smoker is a very important characteristic affecting the desirability of a particular brand. The resistance to draw of a cigarette as it is smoked must be within desirable limits. The total mass of tobacco content of the rod should also be controlled, in that if total tobacco content varies, several other characteristics of the finished product may vary. All of the above characteristics are affected by the temperature level at which the tobacco filler transits the maker.

It follows, therefore, that if it is desired to produce cigarettes of a given set of specific in-pack characteristics then the entry temperature of the tobacco filler into the rod forming section of the maker must be factored in along with the control of rod firmness, filler moisture content, and Beta gage or total mass readings in order to most accurately forecast the eventual in-pack characteristics of the finished cigarettes.

The cigarette making industry has long recognized and has been dominated by the controlling influence which ambient temperature and moisture conditions have on the characteristics of the tobacco filler content of a machine manufactured cigarette product. Great pains are taken to control the temperature and air humidity of the cigarette making workspace for indirectly controlling filler temperature, etc. However, the inventor recognized that such indirect control of the tobacco temperature was not adequate to the needs and demands of present day advances in cigarette making practices. Cigarette making is now carried out in machinery capable of producing 5000 cigarettes a minute or more. Furthermore, greater advances in speed are being sought to increase the cigarette hourly production rates. As these projected increases in production rates are contemplated, it must be recognized that individual factors such as the particular tobacco filler temperature as it advances to the rod making function become more and more critical to the production of a product of high quality and desired characteristics. Very positive control of the filler conditions such as a reduction in filler temperature must be maintained to allow for greater productivity while assuring predictable, acceptable uniformity of product characteristics and quality. The higher the rate of production desired, the greater the need for more positive control of filler conditions by cooling it to below ambient temperature is needed.

The prior art methods have functioned within the range of ambient conditions of temperature at which a human working environment is comfortably maintained. The moisture content of ambient air in that working environment has been targeted at a particular level to attempt to achieve a degree of control over the filler temperature and moisture content. The level of moisture content in tobacco filler is very sensitive to, and will vary with, ambient moisture content. However filler moisture content will adjust itself based upon the ambient air temperature as well as moisture content. This sensitivity to surroundings is usable to fix moisture content of tobacco, but in accordance with the method of the present invention one may exercise further control by elevating or reducing the temperature of the tobacco.

The moisture content which tobacco assimilates based on ambient conditions is called "equilibration". This means that under given ambient conditions of temperature and moisture, the natural exchange of moisture by the tobacco with the surrounding air will eventually come to a steady-state condition where the exchange of moisture is balance. The term equilibration is readily understood in the trade. To be able to properly target a particular desirable condition of equilibration for cigarettes when eventually at rest in a pack while in the channels of commerce, is a valuable capability. With such a control capability one may positively predetermine and target the exact proportions of moisture filler content needed at a given temperature while making the cigarette rod. Rod firmness, resistance to draw, etc., may also be better provided for when positive control of below ambient temperature of the tobacco filler is exercised during rod formation.

It is to be borne in mind that such characteristics as the above, targeted for and achieved in the pack after equilibration, are not necessarily those exhibited by a cigarette immediately following its manufacture. Thus it becomes extremely important to be able to control the characteristics during processing of tobacco filler in the maker so as to be able to prearrange for and control the characteristics of the newly formed cigarette rod and finished cigarette after reaching, in-pack final equilibration.

The inventor recognized that the above desired condition of equilibration sought to be achieved in the end pack must be provided for in advance through control of the filler characteristics when transiting the making machine. Of prime importance is the need to control the in-process temperature as well as the moisture content, rod firmness, mass measure and other characteristics.

By so controlling the temperature as in the case of the present invention to below ambient temperature and also controlling other above conditions, it is then possible to extrapolate forward and be able to predict pack conditions at eventual equilibration.

Accordingly, it is an object of the present invention to temper tobacco filler by cooling to a desired temperature level prior to or during forming up of a cigarette rod in a making machine to thereby offset heat added by transit through the maker and to idealize speed of production and quality of product and to provide for desired in-pack equilibration levels of moisture content, firmness, feel, and resistance to draw.

It is a further object of the present invention to provide tobacco filler conditioning methods for heating or cooling, i.e.-"temping", the filler prior to entry to, or while within transit through, a maker to counter heat buildup by adhesive heater bars.

It is a further object to provide related apparatus which is adapted to provide such cooling to the filler to better control the speed of making and the physical characteristics of the output rod of tobacco to desired conditions and values, such as for instance the maintenance of a rod temperature which is most suitable for cutting the rod while minimizing the incidence of loose ends.

SUMMARY OF THE INVENTION

In accordance with the principles of the present invention, the above and other objectives are realized in conjunction with a tobacco cooling system which works along with a cigarette maker of conventional design. The maker is adapted to include temperature conditioning means for temperature conditioning of the tobacco to cool said tobacco prior to entry into, and/or within, the conventional cigarette maker tobacco handling system preceding the steps of forming the cigarette rod.

In one aspect of the present invention, the conditioning means is adapted to cool the tobacco filler by means of a tempered air flow created by refrigerating the air in a portion of the pneumatic feed system of the maker. In a further aspect of the invention, the conditioning means cools the tobacco just prior to moving it out of the maker hopper to be fed to the rod making section.

BRIEF DESCRIPTION OF THE DRAWINGS

The above and other features and aspects of the present invention will become more apparent upon reading the following detailed description in conjunction with the accompanying drawings in which.

DETAILED DESCRIPTION OF THE DRAWINGS

Figure 1:
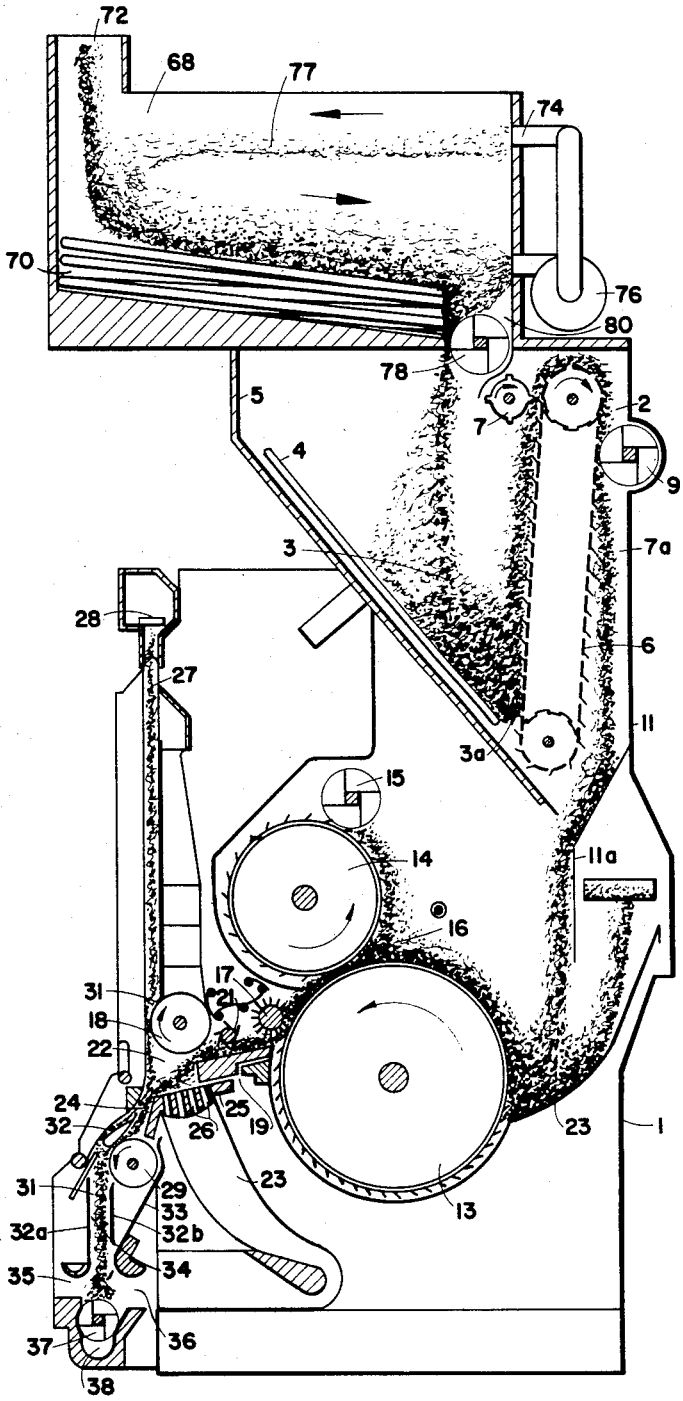
FIG. 1 shows, partially diagrammatically and in cross-section, the relevant tobacco filler feed portion of a cigarette maker adapted in accordance with the invention.

In FIG. 1, the maker 1 is constructed essentially similar to the aforementioned Molins unit, with the exception of the modification in accordance with the invention, as will be discussed below. A hopper 2, only part of which is shown, receives tobacco 3 in a V-shaped region 3*a* defined by a movable fixed platen 4 attached to the hopper wall 5 and a conveyor 6. The latter conveyor 6 transports tobacco material upward past a picker 7 which levels the height of the conveyed tobacco. Excess tobacco is entrained by the picker 7 and returned to the V-shaped region 3*a*. The leveled tobacco is brought by the conveyor to a roller 9 which disengages the tobacco from the conveyor and causes it to drop into the region between the conveyor and a further sidewall 11 of the hopper 2.

The tobacco guided by an extension 11*a* drops to a curved bottom wall 23 adjacent to which is a carding drum 13 rotating in the counterclockwise direction. Drum 13 carries the tobacco past an adjacent counter-rotating carded drum 14 which strips excess tobacco from the drum 13. The tobacco on the drum 13 is moved past a picker 15 which strips the tobacco therefrom causing it to fall to an accumulation region 16 between the two rollers.

The tobacco carpet on the drum 13 is carried past comb 17 to a position at which a clockwise rotating picker roller 18 strips the carpet from the plate 19. The tobacco is fed by the picker roller 18 from the shaped plate 19. A winnower 21 rotating clockwise engages the tobacco on plate 19 and impels the tobacco into a region 22 of the maker where it is subjected to a pressure differential via a pneumatic system.

This system results in a main airstream which flows upward through a curved duct 23 communicating with a supply duct 24. The duct 23 is provided with a plate 25 having apertures 26 through which the main airstream proceeds into the region 22. The airstream flows upward into a tobacco duct 27 at the upper end of which is a foraminous belt 28 through which the airstream also passes.

Air is also drawn through the rotating perforated cylinder 18 with an associated duct 31. This causes selected relatively light tobacco to change its direction of movement and to be carried by the main airstream up the duct 27. This tobacco is held on the belt 28 to initiate formation of the tobacco rod, this process being completed in the customary way by the maker 1.

Heavier tobacco particles are impelled across the path of the airstream on account of their greater momentum, and thus the remainder of the tobacco is delivered to a trap region 32 formed by walls 32*a* and 32*b* and a covered roll 29. The roll 29 delivers the falling tobacco to the passage 31 through which a rising air stream passes as a result of apertures 35 and 36. Thus further light tobacco is carried by the rising airstream up the passage 16 to join the main air stream at the bottom of duct 27, while heavier particles drop downward and are urged by a paddled roller 37 into a catch pipe 38.

In customary practice with the maker 1, the room air in the surrounding environment in the prior art is conditioned to particular temperature levels and moisture content to provide a measure of control over the temperature and moisture of the tobacco filler entering and circulating within the maker and consequently the maker output rod. This outside air, at ambient temperature, is drawn through the openings 35 and 36 and interacts with the tobacco filler as above-described.

In accordance with the improvement of the present invention, prior conditioning of the tobacco filler is provided through direct temperature conditioning of the air and thereby the tobacco filler within a tempering unit 68 which is provided to serve the maker and in which the filler 72 is held in residence long enough to be heated or cooled to the desired feed temperature. Such temperature conditioning of maker feed tobacco can be effected in various fashions and at various locations prior to entry into the maker.

Figure 2:
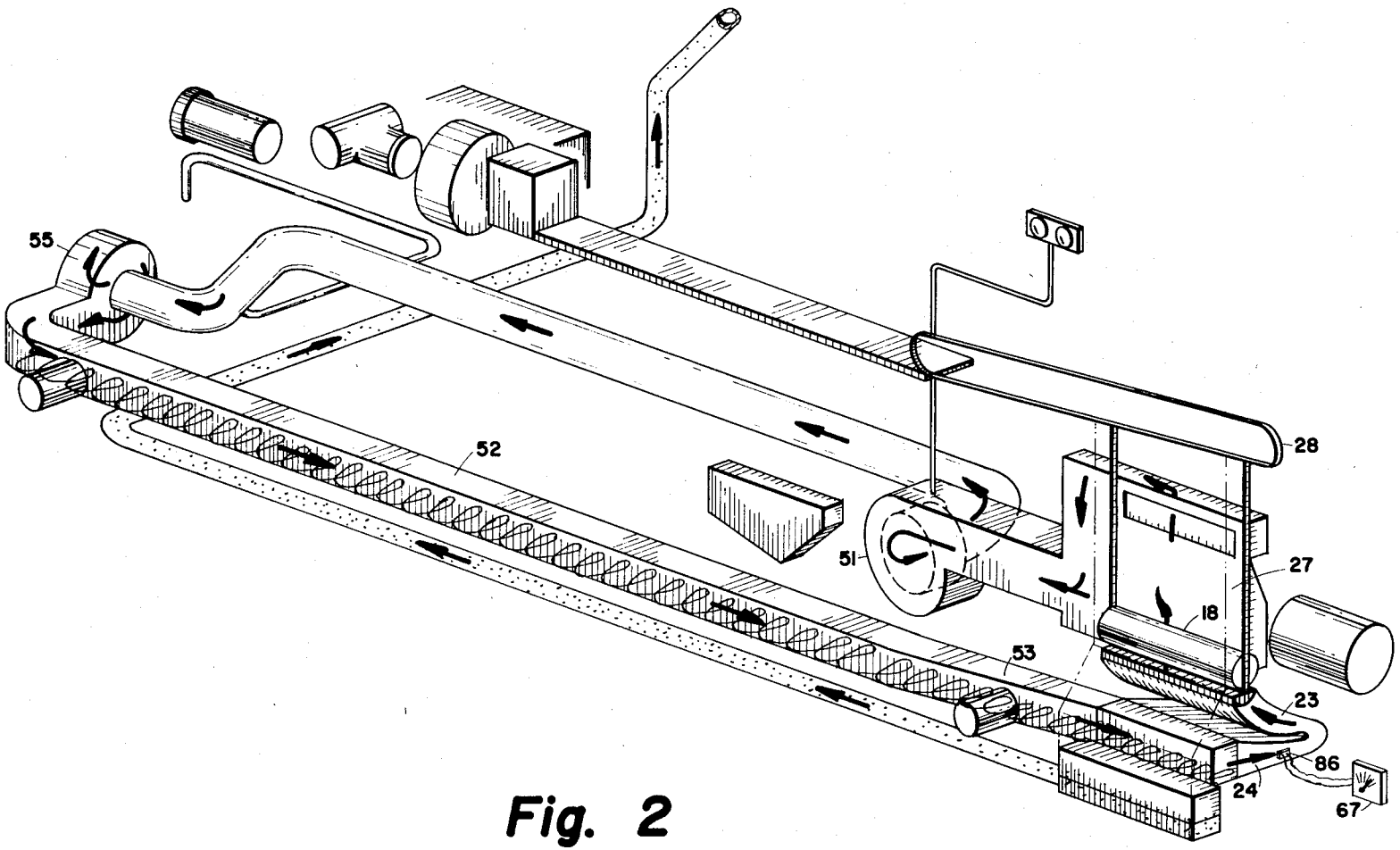
FIG. 2 illustrates diagrammatically in perspective the pneumatic system of the maker of FIG. 1 adapted in accordance with the invention.

The pneumatic system of the maker 1 is shown in some detail in FIG. 2. The duct 24 feeding the curved duct 23 communicates with a fan 51 which helps create the pressure differential discussed above for carrying the tobacco filler through the tobacco duct 27 to the foraminous belt 28. A return duct 52 carries return air passing through a dust separator 53 from a manifold (not shown) communicating with the tobacco duct 27. In the present example, a supercharger 55 attached to the duct 27 further aids the fan 51 in creating the pressure differential for producing the main air stream.

A humidity sensor system (not shown) positioned at a point along the tobacco rod measures moisture content and communicates a signal to a humidity level indicator and humidity controller. A reference humidity is also supplied to the humidity controller which then compares first and second signals when the humidity sensor signal is above or below the reference humidity. It is to be understood that the reference humidity settings are set in such an apparatus to read to an adjusted level to reflect the desired moisture content of the tobacco filler calculated to occur at the temperature at which it transits the maker and to which the filler reverts when it is equilibrated after cutting and packing following the method of the present invention.

A tempering coil assembly 70 provides temperature conditioning of the recirculating unit air in the tempering unit 68 and removes heat from the air in response to signals from a dry-bulb sensor controller unit 67. The latter controller provides signals based upon a reference temperature signal and a dry-bulb sensor signal generated by a dry-bulb 86 disposed in the duct 24.

The temperature conditioning unit thus provides direct control over the temperature of the tobacco by controlling the temperature of the recirculating air stream impinging upon the tobacco filler.

The conditioning unit can be placed elsewhere in the system in various positions relative to the maker as long as the conditioning temperature level achieved is such as to provide the desired temperature effect on the tobacco. Thus, a tempering unit 68 is shown in FIG. 1 as positioned adjacent the maker in a space above the tobacco hopper feeder and designed as a part of the maker itself.

Preselected temperature and humidity values both may be controlled to absolute values designed to provide a given output rod temperature and moisture content. These values might also be derived from sensor signals measuring characteristics of the output rod itself. Thus, conventional sensors for measuring moisture content, density and rod firmness may be used to predetermine and control several parameters in the cooled output rod. These detected values then are used to develop humidity and temperature values for obtaining desired optimum target processing temperature and humidity necessary both for making the tobacco rod more amenable to accuracy in manufacture and to control resultant moisture content desired in the final pack.

One particular advantage of tempering is observed when tobacco rod characteristics are evidenced at the cutting off station. The tobacco rod is segmented into dual cigarette rod portions which later are tipped with tipping paper. These dual rods are then cut in the center to form a pair of individual cigarettes. A pre-cooled rod may retain the packed filler better so that it is less easily dislodged during cutting.

The cutting function is carried out at extremely high speeds and will dislodge tobacco in some cigarettes adjacent the site of the cut if it is not properly tempered. When tobacco tends to fall out of the end, it creates a cigarette which is rejected for having a "loose end."

Loose ends result in the rejection of large numbers of cigarettes just before their placement in packs for shipment. It was found that tempering of the tobacco rod lowered the occurence of loose ends at the loose ends detector station prior to packing. The reduction was made in proportional relationship based upon the degree of accuracy of control of the temperature in the rod in comparison with systems in which temperature is allowed to be controlled by ambient air room temperatures.

Furthermore, if it is desired to cool the rod below ambient temperature, a certain amount of uncontrolled heating of the tobacco must be taken into account. This heating was found to occur in the maker due to the forcible manipulation of the tobacco in the maker, as well as by the presence of resistance heaters which are used in the maker to carry out a gluing function.

Thus, in such a case, cooling the tobacco to offset this internal heating results in a more rigid tobacco rod which will in certain instances better withstand cutting without forming the aforedescribed loose ends.

As stated above, in order to arrive at the exact desirable entry level of temperature for creating specified characteristics of the tobacco rod, the above equipment-induced temperature rise in the tobacco must be factored in. This temperature increase in the tobacco derives only partially from the heater bar which is associated with the cigarette gluing function. A migration of heat takes place from the heater bar to adjacent surrounding structural parts and eventually into the recirculating tobacco filler. This heat also is transmitted by contact of the filler with the structure of the maker and to some extent by contact with air within the maker which also contains some heat picked up from the heater bar.

Temperature measurements of filler at the tobacco entry port of the maker when compared with the temperature measurements of the formed tobacco rod, when no tempering has been done, have shown, at least in one style of maker, a measurable increase of temperature in the rod of tobacco due to the above described internally generated heat which is added during normal entrainment and recirculation of the tobacco in the maker.

The method of the present invention for tempering to control output rod temperature is carried out in the mode herein described by means of a tempering coil 70 shown in FIG. 1 of the drawings. A tempering entry port 72 is provided for receiving fresh tobacco for tempering prior to delivery to the maker hopper. A current of recirculating air which is pre-tempered by suitable means, as shown, is introduced at point 74 and is of a sufficient velocity to carry a portion of the tobacco 77 upwardly to just below the top of a tempering chamber 68. This results in a recirculating pattern as shown by the arrows. The volume and temperature of tempered air as recirculated by the blower 76 is calculated to bring the tobacco 77 to within a range of temperature of from 32° F. to just below ambient as may be found most desirable. It then exits through a winnower 78 shown at exit port 80 which discharges the tempered tobacco into the conventional type feed hopper 2. This then feeds the tobacco to the maker 1 in accordance with its designed requirement for receiving and processing the tobacco for forming into a cigarette rod.

In practice of the invention, to start the process, a measured supply of tobacco is first fed into the tempering area through entry port 72 and allowed to recirculate under the influence of the cooling process. The tempering function is allowed to proceed until such time as the desired level of temperature is reached in the tobacco. In the next step the maker is started and the winnower 78 is activated to begin to discharge tempered tobacco into the hopper feed system leading to the maker feed apparatus. The speed of the winnower 78 is adjusted to match the rate of usage of tobacco required by the maker. The temperature of the tobacco in the cigarette rod is monitored by suitable means and the tempering rate of the apparatus is adjusted to keep the tobacco at proper temperature needed to maintain the resultant cigarette rod temperature at the target level.

At the desired target level temperature, the completed cirgarette rod is fed to a rod cutter, and subsequently advanced to receive a filter and filter tipping, if desired, in conventional better withstand.

At the controlled temperature, the cigarette rod is more cohesive and tends to hold its integrity of shape and fill better during cutting and tipping and thus also can withstand better the handling in subsequent packaging operations.

Furthermore, the tempering of the tobacco and the consequent improved control of the cigarette rod characteristics lends itself to better control of the entire cigarette making process. Under modern conditions of extremely high speed in manufacturing of cigarettes, a properly tempered rod is more likely to allow for higher machine speeds.

The foregoing reveals the essence of my invention which others can, by applying current knowledge, readily adapt for various applications without departing from the scope thereof, and consequently

What I claim is:

1. A method of making a smoking product including a rod of smoking material comprising the following steps:

a. preparing a filler for a smoking product;

b. tempering said filler by adjusting the temperature of said filler to a below-ambient level; and c. forming a rod of smoking product of said tempered filler in a cigarette making machine comprising a feed hopper while said filler is at said below-ambient temperature level so as to stiffen said rod prior to cutting, said filler being cooled to said below-ambient temperature prior to exit from said hopper.

2. The method of claim 1 wherein said filler is tobacco leaf.

3. The method of claim 1 wherein said filler is made of shredded tobacco leaf.

4. The method of claim 1 wherein said filler is a combination of tobacco and another smoking product.

5. The method of claim 1 wherein said smoking product is tobacco free.

6. The method of claim 1 comprising the additional step of encasing said rod in a wrapper.

7. The method of claim 6 comprising the additional step of separating said rod into segments of given length.

8. The method of claim 7 comprising the additional step of affixing a filter plug to said rod segments.

9. The method of claim 8 comprising the additional step of overwrapping said rod segment and said filter plug for securing one to the other.

* * * * *